United States Patent [19]

Duruz et al.

[11] Patent Number: 4,824,531

[45] Date of Patent: Apr. 25, 1989

[54] ELECTROLYSIS METHOD AND PACKED CATHODE BED FOR ELECTROWINNING METALS FROM FUSED SALTS

[75] Inventors: Jean-Jacques R. Duruz; Jean-Pierre Derivaz, both of Geneva, Switzerland

[73] Assignee: Eltech Systems Corporation, Boca Raton, Fla.

[21] Appl. No.: 601,810

[22] Filed: Apr. 16, 1984

Related U.S. Application Data

[63] Continuation of Ser. No. 316,331, Sep. 3, 1981, abandoned.

[30] Foreign Application Priority Data

Jan. 28, 1980 [GB] United Kingdom ..... 80102728

[51] Int. Cl.[4] ..... C25C 3/06

[52] U.S. Cl. ..... 204/67; 204/243 R

[58] Field of Search ..... 204/67, 243 R

[56] References Cited

U.S. PATENT DOCUMENTS 4,338,177 7/1982 Withers et al. ..... 204/67

*Primary Examiner*—John F. Niebling

*Attorney, Agent, or Firm*—John J. Freer

[57] ABSTRACT

Described is a cell for the electrowinning of metals from fused salt baths, especially aluminum from cryolite-alumina, featuring a packed cathode bed of loose refractory materials resistant to the molten metal and disposed at the base of the cell.

25 Claims, 1 Drawing Sheet

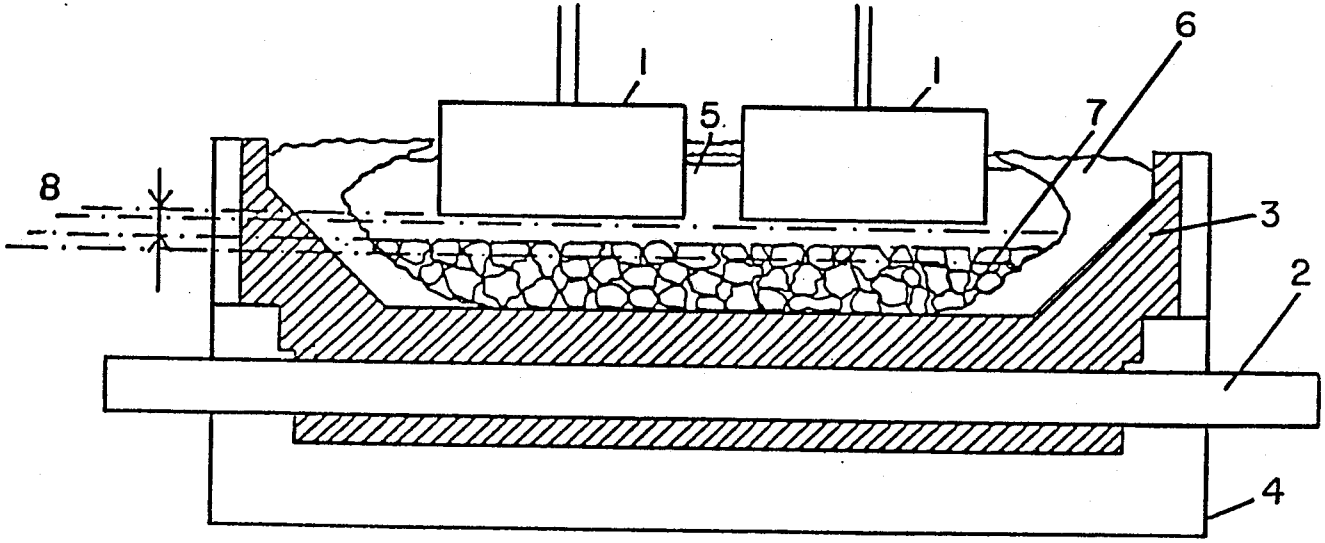
1
1
2
3
4
5
6
7
8

ELECTROLYSIS METHOD AND PACKED CATHODE BED FOR ELECTROWINNING METALS FROM FUSED SALTS

This application is a continuation of application Ser. No. 316,331, filed Sept. 3, 1981 now abandoned.

BACKGROUND OF THE INVENTION

The invention relates to electrolytic cells for electrowinning metals from a fused salt bath, especially aluminium from a fused cryolite-alumina bath comprising at least one anode immersed in said bath above a cathode disposed at the bottom of the cell. In conventional Hall-Heroult electrolytic cells for aluminium electrowinning, a molten aluminium pool of about 15 cm height or more is, for a variety of reasons, maintained at the bottom of the cell to provide a continuous surface for passage of the cathode current.

Movement of the molten aluminium due to strong magnetohydrodynamic and other effects leads to a variable surface of the aluminium pool and thereby imposes a minimum anode-cathode distance of about 4–6 cm.

It has been proposed to equip metal electrowinning cells with different types of cathode structures mounted on the cell bottom in order to allow the molten metal to be continuously drained off so that the anode-cathode distance may be reduced.

Thus, for example, U.S. Pat. No. 4,071,420 relates to a method of metal electrowinning, which comprises providing at least one hollow body which protrudes out of the molten metal pad, is open at its end closest to the anode surface, and is sealed at its end in the pad. The molten metal is thus caused to overflow at a fixed level from the open end of said hollow body.

U.S. Pat. Nos. 3,400,061 and 4,093,524 moreover relate to cells for aluminium electrowinning, which comprise an inclined cathode surface for draining off the molten aluminium except for a thin layer of molten metal wetting the cathode surface. However, the fabrication, precise positioning and fixation of such cathodic structures are both complicated and expensive, especially in the case of retrofitting existing electrolytic cells with such cathodes.

Thus, although a reduction of the anode-cathode distance would evidently be desirable for achieving significant energy savings, and in spite of the fact that considerable efforts have been devoted to developing wettable cathodes for this purpose, the technical difficulties of retrofitting existing cells or equipping redesigned cells with the cathodes proposed hitherto have been a major obstacle to achieving this purpose.

BRIEF DESCRIPTION OF THE INVENTION

The invention has the object of providing a cathode for electrowinning metals from a fused cryolite-alumina bath, in such a manner that the above-mentioned problems may be substantially overcome. To this end, the invention provides a packed cathode bed of loose packing elements disposed at the bottom of an electrolytic cell, as set forth in the claims. Said packing elements of the cathode bed according to the invention consist essentially of a refractory material which is substantially resistant to attack and preferably wettable by the molten metal electrolytically produced in the cell. These packing elements may have any suitable size or shape allowing them to be easily stacked upon and/or aside one another so as to form a packed cathode bed according to the invention and to thereby substantially restrict movement of the electrowon molten metal.

Said packing elements used to form a packed cathode bed according to the invention should consist of a refractory material which has a higher density than the molten metal and is preferably substantially wettable by the molten metal under the operating conditions of the cathode in said cell, in order to allow the liquid metal to spread along the surface of the packing elements and to fill the empty space within said bed.

BRIEF DESCRIPTION OF THE DRAWING

The drawing illustrates an embodiment of a packed bed cathode cell according to the invention.

DETAILED DESCRIPTION

Said refractory material should be substantially resistant to attack by the molten metal in order to avoid significant contamination of the electrowon metal by said material, while ensuring prolonged use of the packing elements. In addition, said packing material may have a sufficient electronic conductivity to allow the passage of the electrolysis current through the packing elements forming the packed cathode bed, as will be explained more fully further on. Titanium diboride meets these requirements for aluminium electrowinning and may be used advantageously as a refractory material to provide said packing elements, which may consist entirely of or at least be covered with this material.

Among possible refractory packing materials which may be suitable with regard to wettability, stability and conductivity, the following may be mentioned for example: borides of titanium, tantalum, niobium, aluminium, zirconium or mixtures of said borides among themselves; and mixtures of said borides with nitrides of silicon, titanium, zirconium, aluminium, and boron.

The invention further provides a method of electrowinning metals from a fused salt bath, especially aluminium from a fused cryolite-alumina bath, in an electrolytic cell comprising a packed cathode bed composed of loose packing elements according to the invention, as set forth in the claims.

The invention also provides an electrolytic cell comprising a packed cathode bed as set forth in the claims.

One method comprises maintaining the molten metal at a level adjacent to the top of said packed cathode bed. Thus, for example, the electrolytic cell may be operated so that the level of molten metal is maintained slightly below the top of said packed cathode bed, e.g., at a distance of about 1 cm below the top of the bed. In this case, the packing elements at the top of the packed cathode bed should preferably have a relatively small mean size, lying, for example, in the range of 1–5 cm, although this size may vary according to the particular shape of the packing elements used.

An aluminium electrowinning cell comprising a packed cathode bed according to the invention may also be operated so that the level of the molten metal is maintained at a short distance above the top of the packed bed. All of the packing elements of said bed will thus be completely immersed in the molten metal so that the top of the packed cathode bed is covered with a thin liquid layer presenting a liquid cathode surface. However, the thickness of this liquid layer should not be so great as to allow so much movement of the molten metal in said layer as to offset the stabilizing effect of the packed cathode bed.

Said packing elements may have any suitable regular or irregular shape. Thus, for example, the refractory packing elements used to form a packed cathode bed according to the invention may have the shape of conventional packings currently used in packed columns, e.g., Raschig rings, saddle rings, balls, etc. The invention may further be illustrated with reference to the FIGURE in the accompanying drawing which shows a vertical section through an aluminium electrowinning cell equipped with a packed cathode bed composed of refractory packing elements according to the invention.

The FIGURE of the drawing shows schematically the following conventional parts of an electrolytic cell for carrying out the Hall-Heroult process: carbon anodes 1, a cathode current bar 2 embedded in a carbon lining 3, and an outer insulating layer 4. The molten cryolite-alumina bath 5, as well as the surrounding freeze 6 are also shown in the FIGURE. This FIGURE shows a packed cathode bed composed of loose refractory packing elements 7 disposed on the bottom of the cell so that the top of the bed reaches a constant mean level 8 spaced at a predetermined short vertical distance from the bottom of the anodes 1. The packing elements 7 may consist of titanium diboride and have any desired size and shape, elements 7 or irregular size and shape being shown as an example.

During operation of the cell, the molten aluminium electrolytically produced may be allowed to reach a predetermined level adjacent to said mean level 8 of the top of the porous bed.

According to one mode of operation of the described cell, the molten aluminium may be allowed to reach a level lying below said mean level 8 of the top of the porous bed of packing elements 7. In this case, the electrolysis current may pass from the packing elements 7 at the top of the packed bed to the anodes 1, while molten aluminium electrolytically produced on these elements 7 at the top of the bed will wet their surface and go into the packed bed.

According to another mode of operation of the described cell comprising the bed of packing elements 7, the molten aluminium may be maintained at a level lying slightly above the mean level 8 of the packed bed. In this case, the molten aluminium forms a liquid cathode surface lying only a short distance, for example, of the order of 5 cm or less, above the top of the bed of packing elements 7 which would now all be fully immersed in the molten aluminium. Movement of the molten aluminium may thus be substantially restricted within the packed cathode bed as well as in the relatively thin liquid metal layer covering said bed. The molten aluminium may be discharged continuously or intermittently so as to keep its level more or less constant.

The packed cathode bed of packing elements according to the invention provides various important technical and economic advantages, namely:

The loose packing elements of the bed do not require any special fixation to the cell or to each other.

Existing electrowinning cells may thus be retrofitted by placing said packing elements on the cell bottom to form the packed bed.

The packing elements placed at the cell bottom do not usually require complicated shapes of large size or precise dimensions.

The packed cathode bed requires minimum maintenance costs since the loose packing elements may be easily replaced, if necessary.

The anode-cathode distance may thus be significantly reduced at low cost by means of the packed cathode bed.

It may thus be possible to maintain a reduced distance of the order of 1 cm, for example, between the anode and the cathode especially when the electrolytic cell comprises a packed bed cathode according to the invention in combination with dimensionally stable, oxygen-evolving anodes.

Laboratory experiments were carried out with a small electrolysis cell wherein aluminium was produced on a bed of packing elements according to the invention.

The electrolysis cell used for this purpose comprised a crucible of dense graphite equipped with a sheath of alumina (80 mm diameter, 200 mm height). Refractory packing elements of 7 mm diameter and 7–11 mm length, consisting of sintered titanium boride were randomly disposed in an inner central cylinder of alumina (50 mm diameter, 20 mm height) to form a loose packed cathode bed at the bottom of the graphite crucible. A cylindrical carbon anode of 50 mm diameter suspended from an anode current collector was mounted axially so that the bottom end of the anode was arranged at a distance of 40 mm from the top of said inner cylinder.

The described cell arrangement was filled with a cryolite-ten percent alumina mixture, placed in a vessel, closed off, and heated in a furnace to melt the cryolite-alumina mixture. Electrolysis was carried out by passing a current for 20 A for 5 hours. At the end of this operation, the inner cylinder was filled with molten aluminium. A solidified block was removed from the inner cylinder, cross-sectioned, and examined under a microscope. This examination showed that the electrowon aluminium completely filled the packed bed and had displaced all of the cryolite-alumina initially present. The current efficiency was 65 percent.

What is claimed is:

1. In an electrolytic cell for electrowinning molten aluminum from a fused cryolite-alumina bath, the cell including at least one anode arranged in said bath above a cathode associated with a base of the cell, the improvement comprising: a packed cathode bed composed of conductive refractory packing elements of higher density than molten aluminum and resistant to attack by molten aluminum, which are loosely stacked upon one another from the base of the cell, whereby during operation of the cell, molten aluminum is produced on said packing elements and fills the empty space within the packed cathode bed, so as to substantially restrict movement of the molten aluminum.

2. The improved electrolytic cell of claim 1, wherein said packing elements are readily wetted by molten aluminum.

3. The cell of claim 2, wherein said packing elements are composites of refractory metal borides and refractory metal nitrides.

4. The cell of claim 2 characterized in that said refractory packing elements comprise at least one boride of a metal selected from the group consisting of titanium, tantalum, niobium, aluminium, and zirconium.

5. The cell of claim 4, wherein said packing elements also contain one or more nitrides of silicon, titanium, zirconium, aluminum and/or boron.

6. A method of electrowinning molten metal from a fused salt bath in an electrolytic cell comprising at least one anode and the cathode of claim 1 characterized in that the molten metal is maintained at a level adjacent to the top end of said packed bed.

7. A method as in claim 6 wherein said metal is 5 cm or less above the top of said bed.

8. An electrolytic cell for electrowinning molten aluminum from a fused cryolite-alumina bath, comprising at least one anode immersed in said bath above a cathode disposed at the base of the cell, characterized in that the cathode comprises a packed bed of loose refractory packing elements which consist essentially of material that is substantially resistant to attack by molten aluminum, said bed reposing at the base of the cell so as to substantially restrict movement of the molten aluminum.

9. A cell as in claim 8 characterized in that said material is wettable by said molten aluminium and is electrically conductive.

10. A cell as in claim 8 characterized in that said material is electrically nonconductive.

11. In an electrolysis method, including electrolyzing, between anodic and cathodic surface areas, a compound dissolved in a solvent, wherein a liquid cathodic body is located in a region such that it is possible for waves in the body to touch anodic surface area, the improvement comprising placing a bed of objects into said region, the objects touching one another in said body, there being interstices between the objects for accommodating liquid of said body.

12. A method as claimed in claim 11, wherein said compound is a compound of a metal, and said liquid cathodic body comprises said metal.

13. A method as claimed in claim 12, wherein said metal is aluminum.

14. A method as claimed in claim 13, wherein said compounds is alumina.

15. A method as claimed in claim 11, wherein said objects are formed of electrically conductive material.

16. A method as claimed in claim 11, wherein the liquid cathodic body increases in thickness during electrolysis and is tapped when its thickness exceeds the thickness of the bed, tapping being terminated before the thickness of the liquid cathodic body becomes less than the thickness of the bed.

17. A method as claimed in claim 16, wherein the liquid cathodic body increases in thickness during electrolysis and is tapped before its thickness exceeds the thickness of the bed.

18. In an alumina reduction cell having an anode, a carbonaceous cathode and a packed bed of refractory packing elements lying on and in contact with said carbonaceous cathode but not attached thereto and within a pad of and wettable by molten aluminum, the improvement wherein said refractory packing elements are hollow shapes between which and through which said molten aluminum may pass.

19. The cell of claim 18 wherein said refractory packing elements are in the form of rings.

20. The cell of claim 18 wherein said refractory packing elements are formed from a material selected from the group consisting of titanium diboride and titanium boride-aluminum nitride mixtures.

21. In an electrolysis method, including electrolyzing, between anodic and cathodic surface areas, a compound dissolved in a solvent, wherein a liquid cathodic body is located in a region such that it is possible for waves in the body to touch anodic surface area, the improvement comprising placing a bed of objects into said region, the objects touching one another in said body, there being interstices between the objects for accommodating liquid of said body, said objects being hollow shapes wettable by said liquid cathodic body and between which and through which said liquid of said cathode body may pass.

22. A method as claimed in claim 21 wherein said liquid cathodic body is molten aluminum.

23. A method as claimed in claim 22 wherein said electrolysis method is carried out in an aluminum reduction cell having an anode and a carbonaceous cathode, with said bed of objects lying on and in contact with said carbonaceous cathode but not attached thereto.

24. A method as claimed in claim 23 wherein said refractory packing elements are in the form of rings.

25. A method as claimed in claim 23 wherein said refractory packing elements are formed from a material selected from the group consisting of titanium diboride and titanium boride-aluminum nitride mixtures.

* * * * *